United States Patent [19]

Nishiura

[11] Patent Number: 4,983,054

[45] Date of Patent: Jan. 8, 1991

[54] DATA LATCHING FOR PREHEAT AND PRINT CONTROL IN A THERMAL PRINTER

[75] Inventor: Masaaki Nishiura, Fukaya, Japan

[73] Assignee: Kabushiki Kaisha Toshiba, Kawasaki, Japan

[21] Appl. No.: 285,417

[22] Filed: Dec. 16, 1988

[30] Foreign Application Priority Data

Dec. 18, 1987 [JP] Japan ..... 62-320407

[51] Int. Cl.[5] ..... B41J 2/38; B41J 2/355

[52] U.S. Cl. ..... 400/120; 346/76 PH

[58] Field of Search ..... 400/120; 346/76 PH

[56] References Cited

U.S. PATENT DOCUMENTS

| | | | |
|---|---|---|---|
| 4,415,908 | 11/1983 | Sugiura | 346/76 PH |
| 4,492,482 | 1/1985 | Eguchi | 346/76 PH |
| 4,560,988 | 12/1985 | Moriguchi | 346/76 PH |
| 4,560,993 | 12/1985 | Hakoyama | 346/76 PH |
| 4,568,817 | 2/1986 | Leng | 346/76 PH |
| 4,673,952 | 6/1987 | Setoyama | 346/76 PH |
| 4,748,455 | 5/1988 | Mori | 346/76 PH |

FOREIGN PATENT DOCUMENTS

| | | | |
|---|---|---|---|
| 55-150388 | 11/1980 | Japan | 400/120 |

*Primary Examiner*—David A. Wiecking
*Assistant Examiner*—Steven S. Kelley
*Attorney, Agent, or Firm*—Cushman, Darby & Cushman

[57] ABSTRACT

A thermal printer is comprised of a buffer RAM for storing print data, a thermal head, and a CPU for controlling the feed of current to the thermal head. The thermal head includes a number of heating resistor elements. When current is fed to the heating resistor elements during a print period, the heating resistor elements of the thermal head are heated to color a thermosensible paper. The CPU controls a current feed period of the thermal head during the present print period in accordance with both the present print data stored in a buffer RAM and the print data in a previous print period preceding to the present print period.

16 Claims, 11 Drawing Sheets

| SDn \ SDn-1 | 0 | 1 |
|---|---|---|
| 0 | ta | 0 |
| 1 | t=ta+tb | tb |

| SDn \ SDn-1 | 0 | 1 |
|---|---|---|
| 0 | 0 | 0 |
| 1 | t = ta + tb | tb |

FIG. 11

DATA LATCHING FOR PREHEAT AND PRINT CONTROL IN A THERMAL PRINTER

BACKGROUND OF THE INVENTION

1. Field of the Invention

This invention relates to a thermal printer for coloring thermosensible paper by means of Joule heat produced by heating resistor elements.

2. Description of the Related Art

One known printing device contains a thermal printer colors thermosensible paper by means of Joule heat produced by heating resistor elements, and comes in two varieties one is known as a line printer which prints in a line-by-line fashion, while the other, known as a dot printer, which prints in a dot-by-dot fashion for each line of print.

In the thermal printer, current is fed and not fed to each heating resistor element in accordance with the printed data "1" and "0". When current is fed to the heating resistor element, the element generates Joule heat as given by $$(V^2/R)\cdot\Delta t\ (\simeq 3mJ)$$

where

R: the resistance of the heating resistor element,

V: the voltage supplied,

Δt: current feed time period.

This Joule heat colors a thermosensible paper, resulting in printing.

Since the current feed period of a thermal printer using such heating resistor elements if fixed, this results in the density of color not being uniform over all of the printed paper. The heating resistor element generates a fixed amount of Joule heat during a current-feed period, and when the current feed period terminates, dissipates a fixed amount of Joule heat. A surface temperature of the thermal head including the heating resistor elements gradually rises during the current feed period, and gradually falls when the current feed period terminates. Because of the fixed current feed period for the heating resistor elements, when "1" data is successively printed, the printing of the next "1" data starts before the head surface temperature completely drops to the initial temperature. Accordingly, the peak value of the head surface temperature gradually rises, and a color density on the thermosensible paper becomes high Consequently, color densities of dots are not uniform over the paper.

To solve this problem, there is a proposal of a thermal printer as disclosed in KOKAI No. 55-160388. In the proposed printer, the record data applied to the thermal printer is detected, and the next drive pulse of the thermal head is chopped according to a particular detection result. More specifically, if the previous data is "1", the present data is printed in such a way that during a fixed current feed period, the chopped pulse is applied to the thermal head, that is, the actual current feed duration is shorter than the fixed current feed duration. The proposal requires a high frequency clock circuit for generating high frequency drive pulses. Further, during a period that the chopped drive pulse is applied to the head, the previous record data as well as the present record data is also retained. The proposal, therefore, is not applicable for such a printer that when the present data is being printed, accepts the next record data.

The above Gazette also teaches a technique that the record data applied to the thermal head is detected, and a voltage of the next drive pulse for the thermal head is varied on the basis of the detection result Specifically, when the previous record data is "1", the present record data is printed while lowering a voltage of the drive pulse applied to the thermal head, with the intention to lower the heating temperature of the head. It is noted, however, that to change the voltage is to change the current, and this changes various parameters. The change of the parameters makes it difficult to control the current feed to the head.

SUMMARY OF THE INVENTION

Accordingly, an object of the present invention is to provide a thermal printer capable of printing at a uniform color density.

To achieve the above object, there is provided a thermal printer comprising:

buffer means for storing print data to be printed;

heating resistor means for generating heat to color a thermosensible paper when current is fed to the heating resistor means during a print period; and current feed-period control means for controlling during which current is fed to the heating resistor means during the present print period, according to present print data currently stored in the buffer means and print data in a previous print period preceding the present print period.

BRIEF DESCRIPTION OF THE DRAWINGS

FIG. 11 is a table useful in explaining the operation of the printer of a third embodiment.

DETAILED DESCRIPTION OF THE PREFERRED EMBODIMENTS

Figure 1:
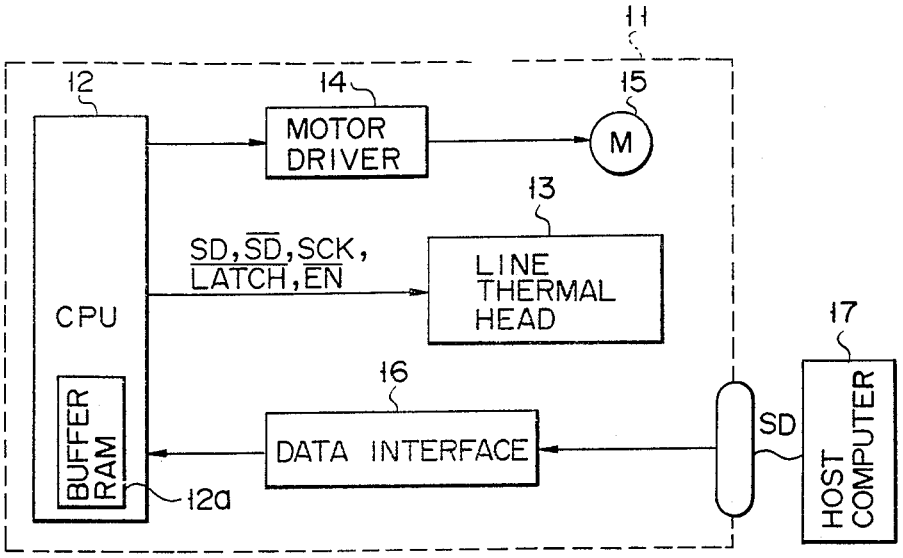
FIG. 1 is a block diagram showing a thermal printer according to an embodiment of the invention.

FIG. 1 is a block diagram showing the overall structure of a thermal printer for performing a print operation line by line, according to a first embodiment of the present invention. Referring to FIG. 1, thermal printer 11 is made up of CPU 12, line thermal head 13, motor driver 14, paper feed motor 15, and data interface 16, and performs printing on the basis of print data SD supplied from host computer 17 to CPU 12, via data interface 16. Upon receipt of print data, CPU 12 stores it in buffer RAM 12*a* incorporated therein, and then supplies it to line thermal head 13. In thermal head 13, currents based on the supplied print data are fed to the related heating resistor elements, resulting in data of one line being printed on thermosensible paper. Upon completion of each one-line printing operation, CPU 12 commands motor drive 14 to drive feed motor 15, in order to advance the thermosensible paper by one line. For 3/mm of the number of dots per unit length, the dot size is 0.33 mm, and the length of advancement of the paper per line is 0.33 mm.

Figure 2:
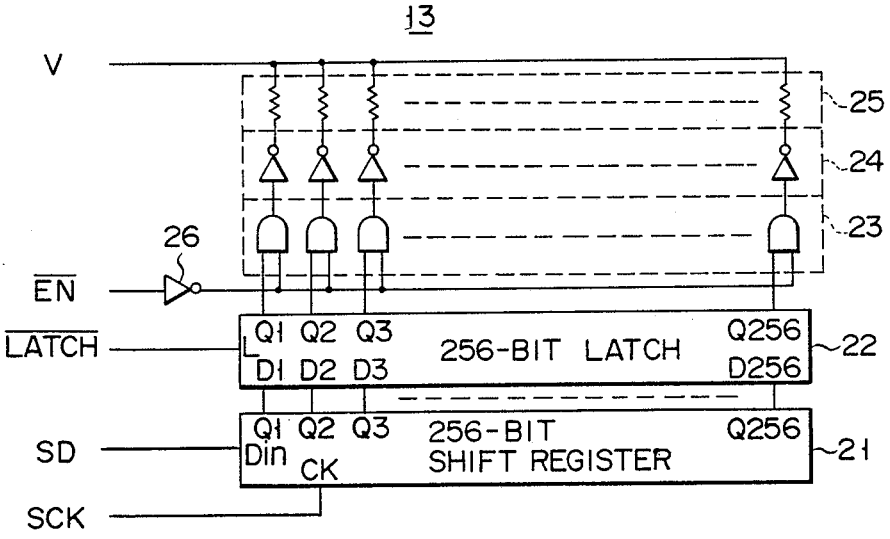
FIG. 2 is a circuit diagram showing a thermal head used in the thermal printer of FIG. 1.

FIG. 2 shows a circuit arrangement of line thermal head 13. Line thermal head 13 is made up of shift register 21, latch circuit 22, gate circuit 23, inverter circuit 24, heating resistor circuit 25, and inverter 26. If the number of dots per line is 256, the number of bits of data handled by shift register 21 and latch circuit 22 is 256. The number of AND gates in gate circuit 23, the number of inverters in inverter circuit 24, and the number of heating resistor elements in heating resistor circuit 25 are each 256.

The operation of the thermal head 13 constructed thus will now be described, with reference to FIGS. 3A to 3M. CPU 12 supplies print data SD and its inverse data $\overline{SD}$ to shift register 21 line-by-line in serial fashion. Data SD and $\overline{SD}$ are sequentially load shift register 21, in synchronism with shift clock signal SCK, and are latched in latch circuit 22, in accordance with latch pulse $\overline{LATCH}$. During a period in which print enable pulse $\overline{EN}$ is low (L) in logical level the latch data passes through gate circuit 23, is inverted by inverter circuit 24, and is then supplied to heating resistor circuit 25. In this way, the flow of current through the heating resistor elements in heating resistor circuit 25 is controlled and a printing operation is performed. Print enable pulse $\overline{EN}$ goes low in logical level when the paper feed is terminated and the thermosensible paper stops.

Figure 3:
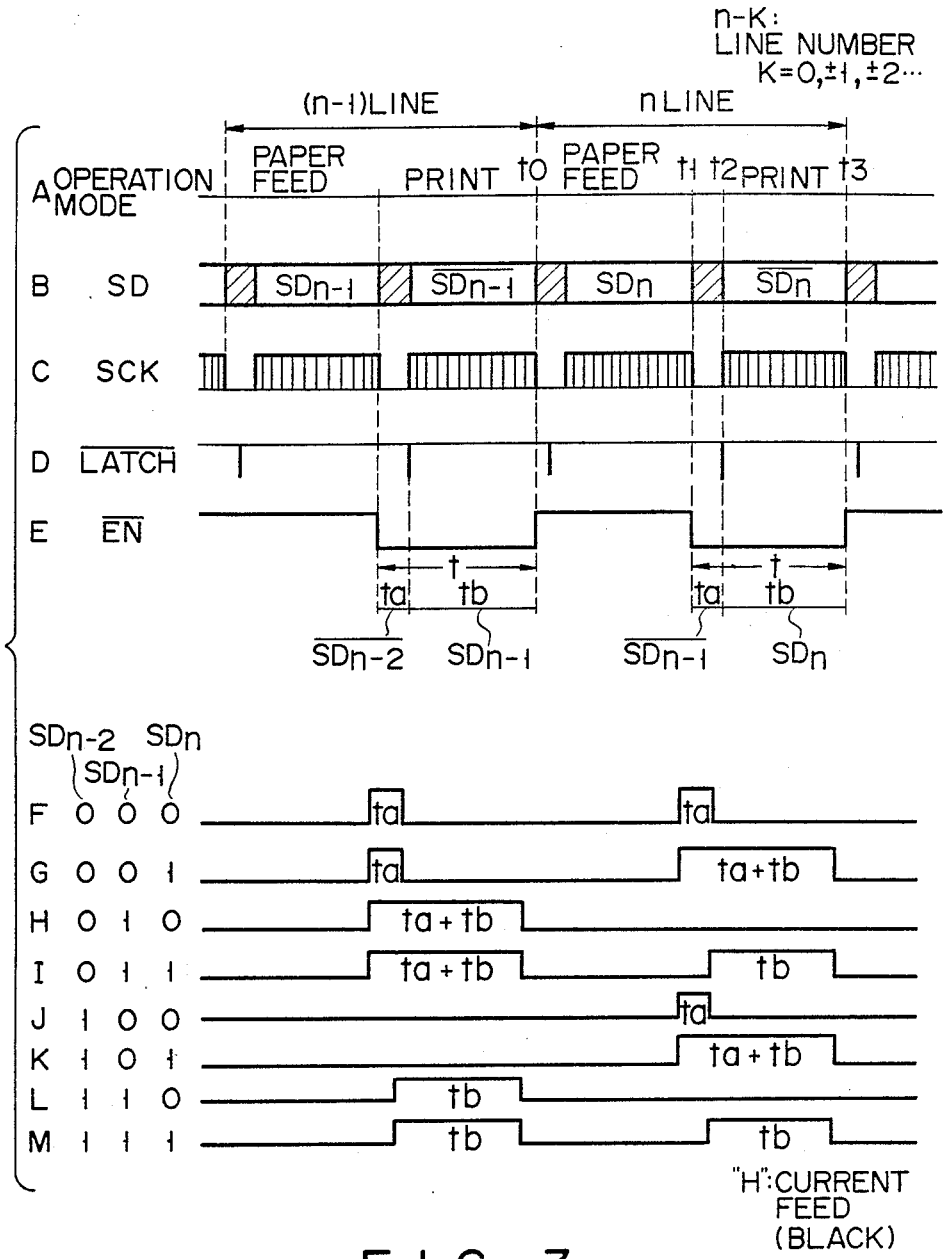
FIGS. 3A to 3M are a set of operation mode waveforms pertaining to various signals, and current feed durations based on data combination patterns.

As is shown in FIG. 3D, first latch pulse $\overline{LATCH}$, for latching print data SD in latch circuit 22, is supplied from CPU 12 outside print time "t" as defined by an L period of print enable pulse $\overline{EN}$, viz., during a paper feed period, and, as is also shown in this Figure, second latch pulse $\overline{LATCH}$, for latching inverse data $\overline{SD}$ in latch circuit 22, is supplied from CPU 12 within print time "t". Print period "t" is divided into period $t_a$ and $t_b$ by second latch pulse $\overline{LATCH}$. In period $t_a$, representing the first half of print period "t", inverse data $\overline{SD}$ of the previous line, as latched by first latch pulse $\overline{LATCH}$, is still latched in latch circuit 22. Accordingly, during period $t_a$, inverse data $\overline{SD}$ of the previous line determines whether or not current is fed to the heating resistor elements in heating resistor circuit 25. During period $t_b$, the print data of the present line as latched by second latch pulse $\overline{LATCH}$ is latched in latch circuit 22. Accordingly, during period $t_b$, the print data SD of the present line determines if current is fed to the heating resistor elements in heating resistor circuit 25.

Figures 4, 5:
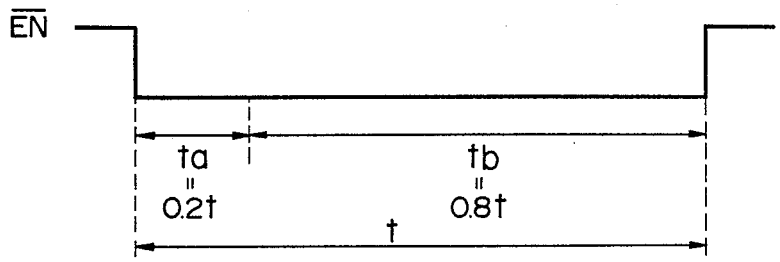
FIG. 4 is a table useful in explaining the operation of the printer of FIG. 1.
FIG. 5 is a signal waveform useful in explaining the operation of the printer of FIG. 1.

In this instance, four current-feed patterns are used, "0", "$t_a$", "$t_b$", and "$t_a+t_b$", as is shown in FIG. 4. In this figure, the patterns for (n−1) line and "n" line are typically shown. For the data of the previous line, print data SD, not inverse data $\overline{SD}$, is used.

Current feed time Δt, as is determined by such current-feed pattern, is mathematically expressed as $$\Delta t = t_a \cdot SD_{n-1} + t_b \cdot SD_n$$

where $SD_{n-1}$ indicates the inverse data of the previous line, and $SD_n$ indicates the print data of the present line. As is shown in FIGS. 3F to 3M, current feed-patterns are each determined according to a combination of print data $SD_{n-2}$ of the previous two lines, print data $SD_{n-1}$ of the previous line, and print data $D_n$ of the present line.

In a situation that no printing is required at the present line, current will be fed to the resistors even when print data SD of the previous line is "0" and print data SD of the present line is "0". In such a case, no problem arises if time period $t_a$ is selected to be such a value as not to color the thermosensible paper and to quickly dissipate heat. A preferable time period $t_a$, is 0.2 t, for example, as is shown in FIG. 5.

Figure 6A:
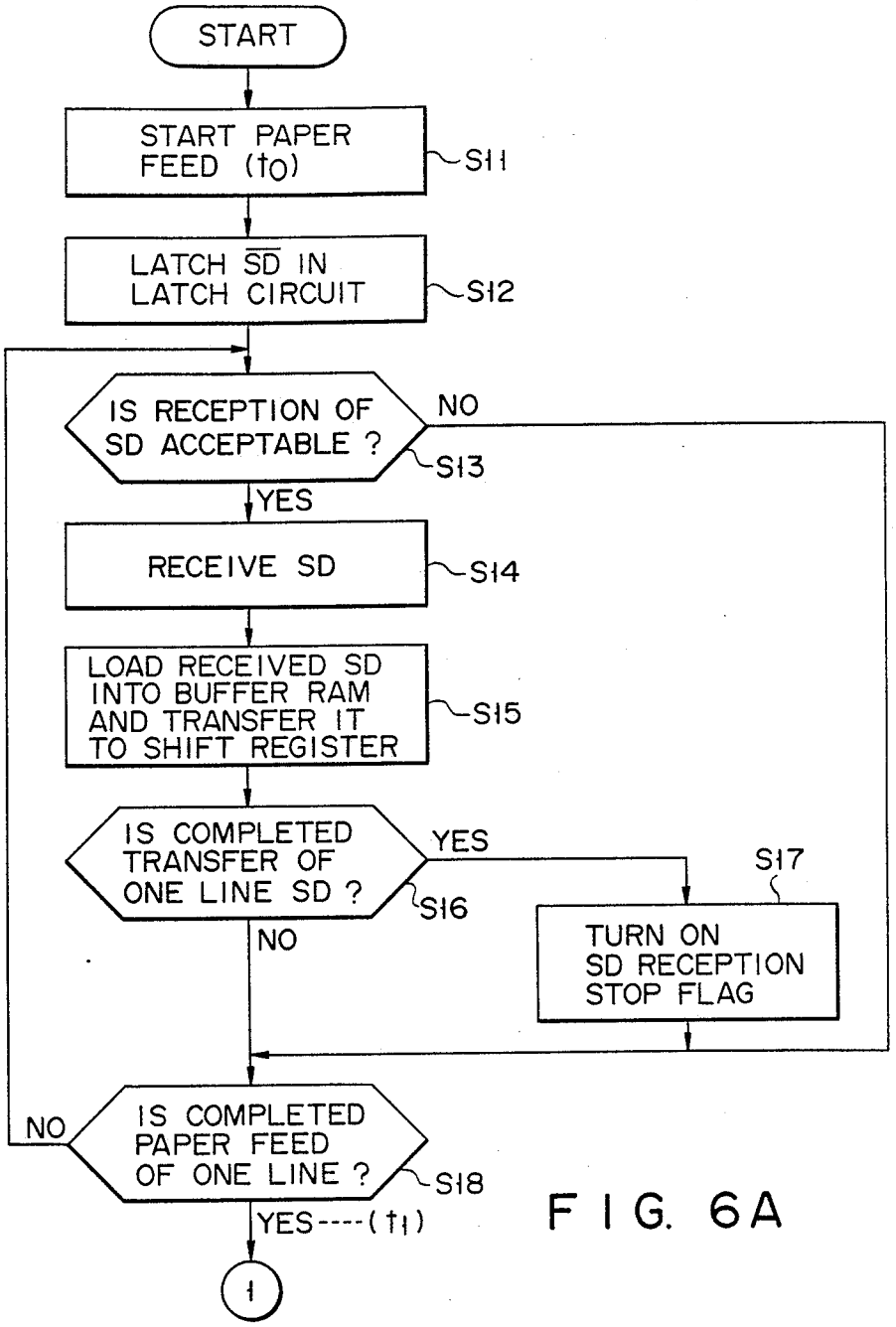
FIGS. 6A to 6C constitute a flowchart useful in explaining the operation of the printer of FIG. 1.
Figure 6B:
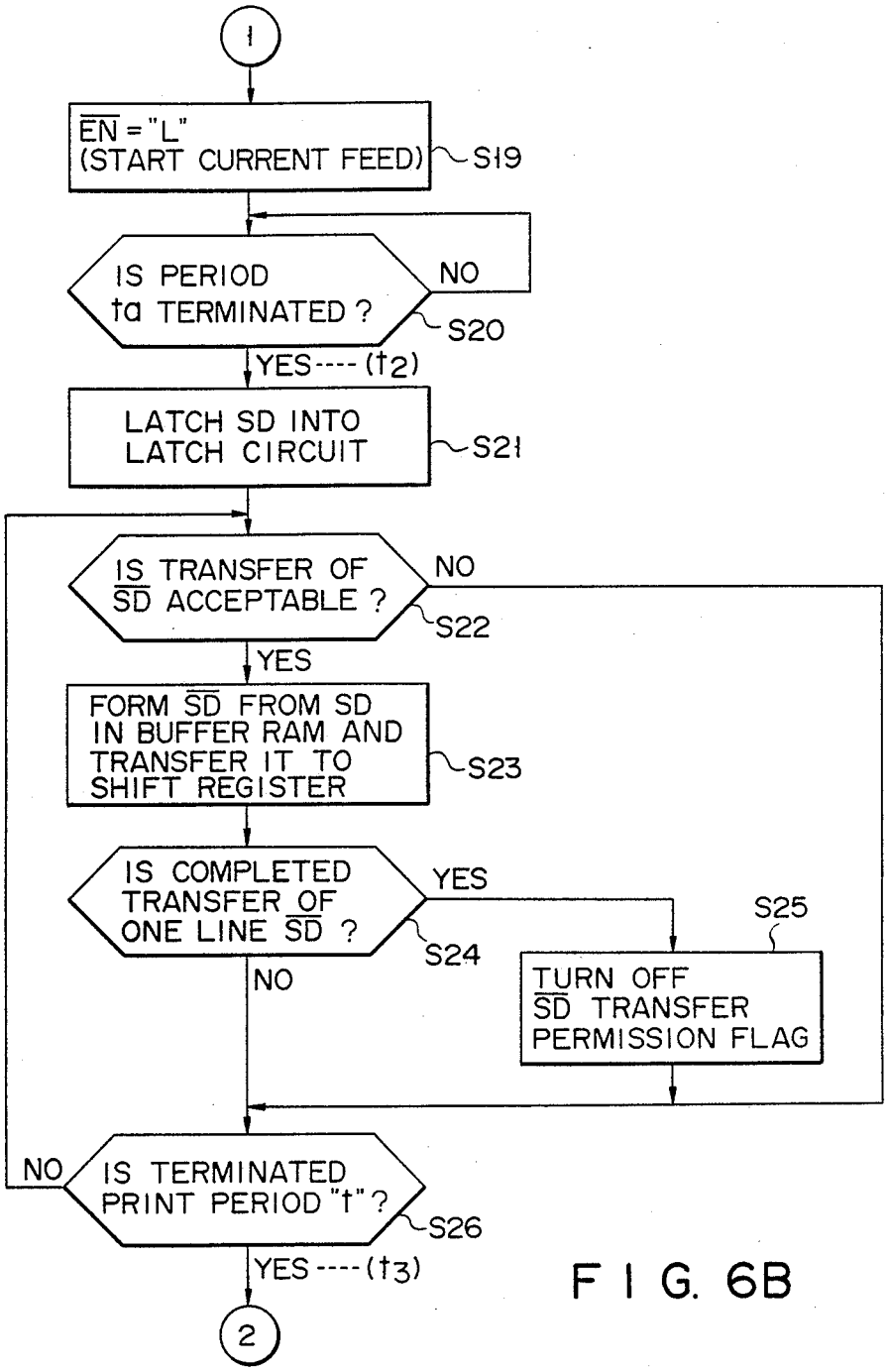
Figure 6C:
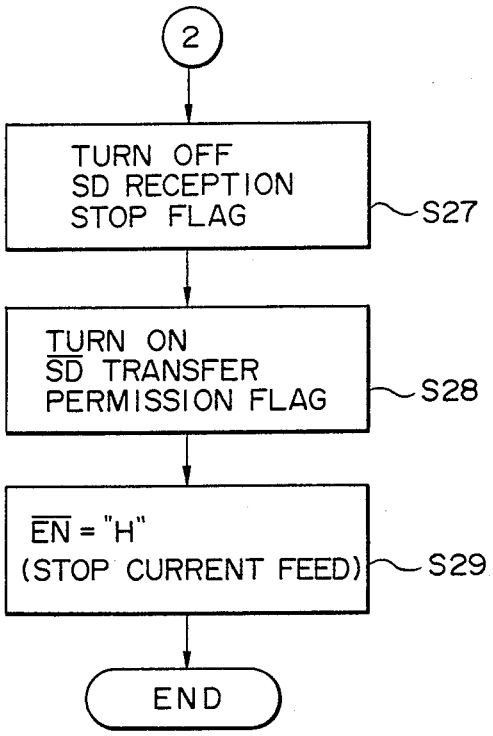

FIGS. 6A through 6C constitute a flowchart showing the paper feed and print processing corresponding to one line according to the first embodiment. The operation for such processings will be described with reference to the figures.

At time point t0 (FIG. 3A), CPU 12 commands motor driver 14 to drive paper feed motor 15, in order to advance the printing paper by one line (step S11). When the thermal head was not in printing before start of the processing of step S11, viz., when the printer receives the print data of the first line from host computer 17, an initializing processing is needed to clear the resisted data in the shift register 21 and the latched data in latch circuit 22 of line thermal head 13. Conversely, when the thermal head was in printing, inverse data $\overline{SD}$ of the previous line has been stored in shift register 21, and print data SD of the previous line has been latched in latch circuit 22.

Then, first latch pulse $\overline{LATCH}$ is output from CPU 12, and inverse data $\overline{SD}$ of the previous line is latched in the latch circuit 22 of line thermal head 13 (step S12). CPU 12 checks if print data SD is receivable or not thereby, by referring to a print data SD reception stop flag (step S13). If the answer is yes, print data SD is received by CPU 12 (step S14), and stored in buffer RAM 12*a* of CPU 12, and is transferred to shift register 21 of line thermal head 13 (step S15). Then, the CPU checks if the reception and transfer of the one-line print data SD have been completed (step S16). If such jobs are completed, the print data SD reception stop flag is turned on (step S17). Next, CPU 12 checks if the paper feed of one line is completed (step S18). When the reception and transfer of the one-line print data SD are not completed, and the paper feed of one line is not completed, the operation is returned to step S13, and repeats the above sequence of operations.

If the paper feed of one line is completed (time point t1) print enable pulse $\overline{EN}$ is set in low level, to set up a current feed state (step S19). In this case, inverse data $\overline{SD}$ of the previous line has been latched in the latch circuit 22 of line thermal head 13 in step S12. Therefore, the heating resistor elements of heating resistor circuit 25 are heated in accordance with inverse data $\overline{SD}$ of the previous line.

Succeedingly, CPU 12 judges if the period $t_a$ in print period "t" terminates or not (step S20). If it terminates (time point t2), second latch pulse $\overline{LATCH}$ is output, the print data SD of the present line is latched in the latch circuit 22 of thermal head 13 (step S21). Consequently, current is fed to the heating resistor elements of resistor circuit 25 according to the latched print data SD of the present line.

CPU 12 judges whether it is allowed or not to transfer inverse data $\overline{SD}$ to the shift register 21 of line thermal head 13 (step S22). This is done with reference to the inverse data $\overline{SD}$ transfer permission flag. If it is possible, the print data SD stored in buffer RAM 12a in CPU 12 is inverted to form inverse data $\overline{SD}$, and the formed inverse data $\overline{SD}$ is transferred to shift register 21 (step S23). Then, CPU 12 checks whether the transfer of inverse data $\overline{SD}$ of one line is completed or not (step S24). If it is completed, CPU 12 turns off inverse data $\overline{SD}$ transfer permission flag (step S25). CPU 12 checks if print period "t" terminates or not (step S26). If the transfer of inverse data $\overline{SD}$ of one line is not completed and print period "t" does not terminate, the operation returns to step S22, and repeats the above sequence.

If print period "t" terminates (time point t3), CPU 12 turns off the print data SD reception stop flag (step S27), and further turns on the inverse data $\overline{SD}$ transfer permission flag (step S28). Then, it sets print enable pulse $\overline{EN}$ in high level, to set up a current-feed end status (step S29).

In this way, the paper feed and printing operations of one line are performed, and for the next line, if it must be printed, the above sequence of operations will be repeated.

As described, in this embodiment, the print period "t" of each line is divided into two periods, period $t_a$ and $t_b$. During the former period $t_a$, the current fed to the heating resistor elements is controlled according to the inverse data $\overline{SD}$ of the previous line, and during the latter period $t_b$, the print data SD of the present line is used for controlling the current feed to the elements. In this way, the current feed for each line is controlled allowing for the print data SD of the previous line, so that the current feed control will be based on the print history. The resultant printed dots, therefore, is uniform in color density.

Figure 7:
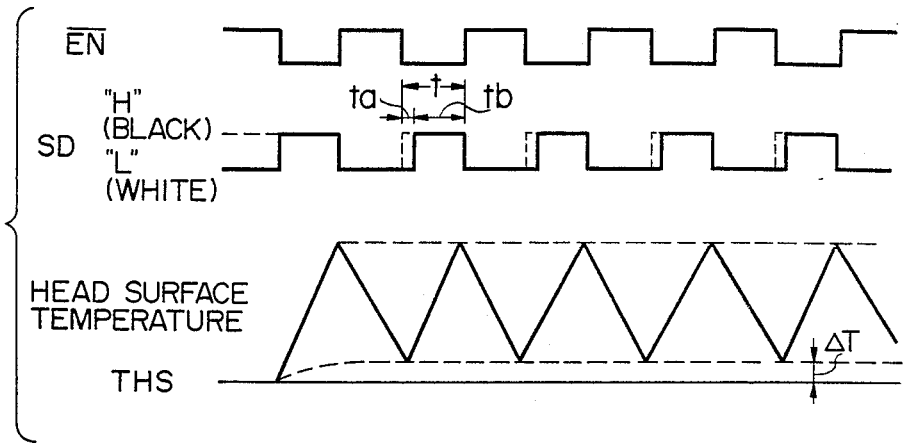
FIG. 7 is a set of waveforms useful in explaining the effects of the invention.

FIG. 7 shows a variation of temperature on the head surface when high level print data SD is fed to the head every line. As seen from the graph, as in the conventional thermal head, the head surface temperature of the printing head fails to drop up to the initial temperature THS, and with progression of printing, the bottom of the temperature drop settles down at storage temperature $\Delta T$, which is above initial temperature THS. In this embodiment, however, when the print data SD of the previous line is high in logical level, the current feed time is reduced by time $t_a$, and consequently, there never occur such a situation that with increment of the printing line, the peak of the head surface temperature gradually rises. As a result, a uniform density of the printed dots may be secured for all the lines.

A second embodiment of the invention will be described.

Figure 8:
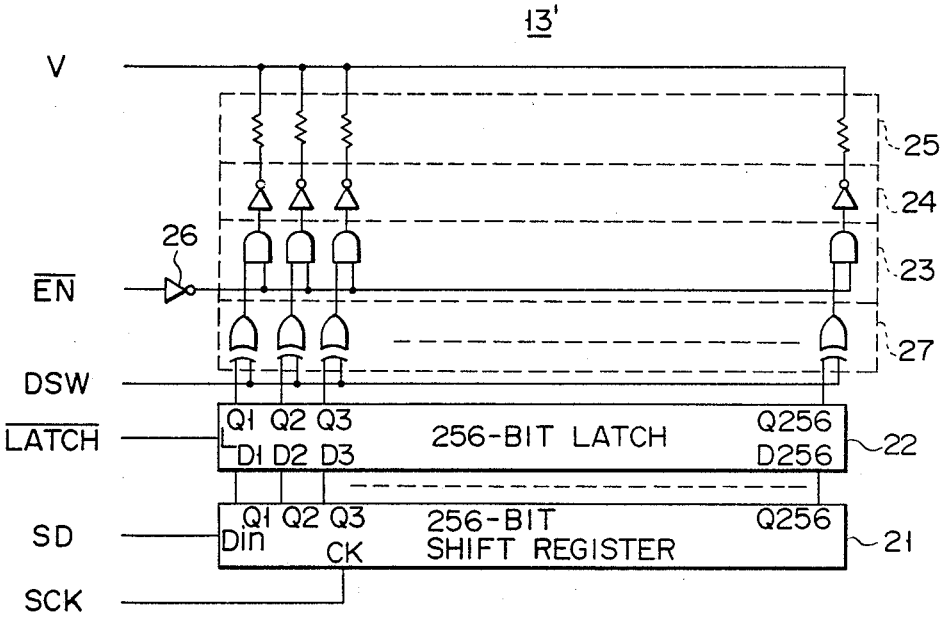
FIG. 8 is a circuit diagram showing a thermal head used in a thermal printer according to a second embodiment of the invention.

FIG. 8 shows a circuit arrangement of a line thermal head in use with a thermal printer according to a second embodiment of the present invention. Major differences of the thermal head 13' from the thermal head 13 in the first embodiment reside in that an inverter circuit 27 made of 256 exclusive OR gates is provided between latch circuit 22 and gate circuit 23, and in the access method to shift register 21 and latch circuit 22.

The operation of the second embodiment will be described with reference to timing charts of FIGS. 9A to 9N. In the second embodiment, only print data SD is supplied to shift register 21, while in the first embodiment, inverse data $\overline{SD}$ is not supplied thereto. In the second embodiment, inverse data $\overline{SD}$ is formed by inverter circuit 27, which will subsequently be described.

Figure 9:
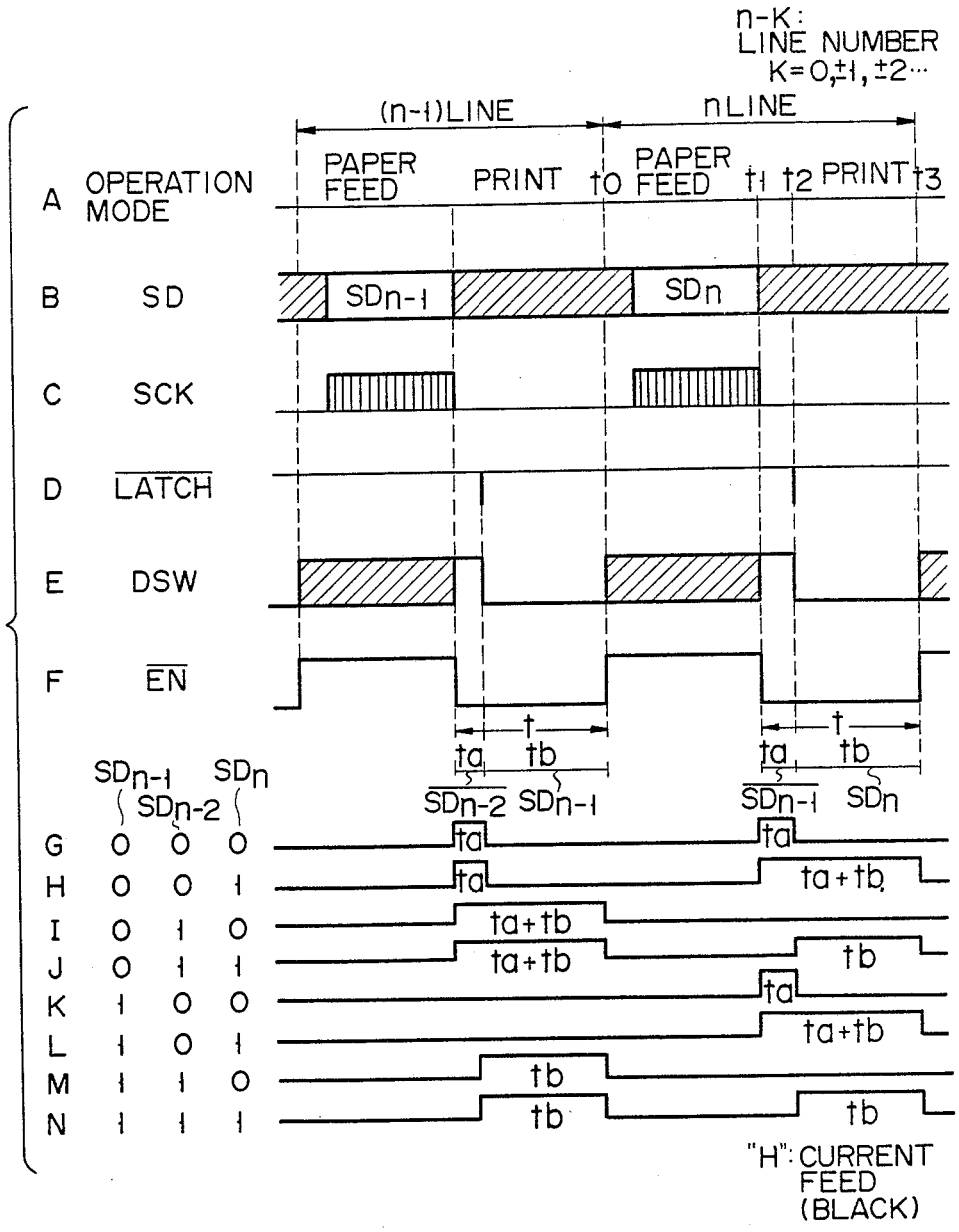
FIGS. 9A to 9N are a set of operation mode waveforms pertaining to various signals, and current feed durations based on data combination patterns in the case of the second embodiment.

The loading of the print data SD to shift register 21 is performed during the paper feed period, as is shown in FIGS. 9A and 9B. A print time "t" as defined by the low level period of print enable pulse $\overline{EN}$ is divided into two periods, $t_a$ and $t_b$. Latch pulse $\overline{LATCH}$ is output at a time point where the two periods $t_a$ and $t_b$ change from one to the other. By this latch pulse $\overline{LATCH}$, the print data SD stored in shift register 21 is latched in latch circuit 22. The latched data is supplied to one of the input terminals of each of exclusive OR gate in inverter circuit 27. The other of the input terminals of each exclusive OR gate is supplied with inverse control pulse DSW from CPU 12. This pulse DSW maintains a high level from the termination of print period "t" to generation of the subsequent latch pulse $\overline{LATCH}$, and maintains a low level from generation of this latch pulse $\overline{LATCH}$ to termination of print period "t". However, the pulse DSW is not always in a high level from the termination of print period "t" to generation of the subsequent latch pulse $\overline{LATCH}$, but it is only needed to be in a high level at least during a period from start of the print period to generation of latch pulse $\overline{LATCH}$.

With such an arrangement, since latch pulse $\overline{LATCH}$ is output during print period "t" from CPU 12, during the former period $t_a$ of the print period "t" for each line, the print data SD of the previous line is supplied to the heating resistor elements. During the latter period $t_b$, the print data SD of the present line is supplied to the heating resistor elements. During period $t_a$, since inverse control pulse DSW is high, the print data SD of the previous line supplied during this time is inverted by inverter circuit 27 and is to be inverse data $\overline{SD}$. Accordingly, if the print data SD of the previous line is high, it is inverted into inverse data $\overline{SD}$ in low level. Conversely, if it is low level print data SD, it is inverted into high level inverse data $\overline{SD}$. Therefore, the current feed duration for each line is controlled by the print history of the previous line, as is shown in FIGS. 9G to 9N.

Figure 10A:
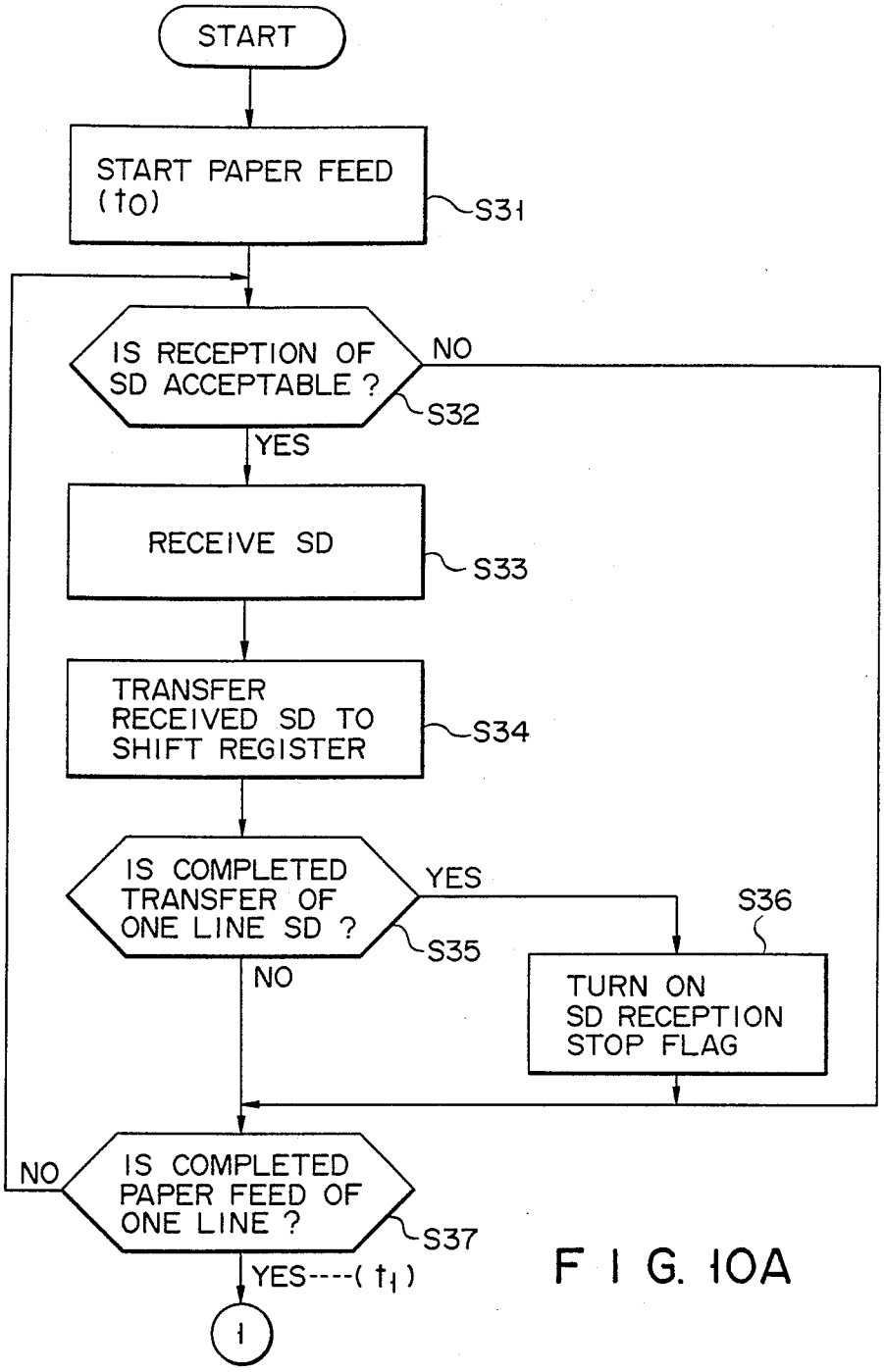
FIGS. 10A and 10B constitute a flowchart useful in explaining the operation of the printer according to the second embodiment.
Figure 10B:
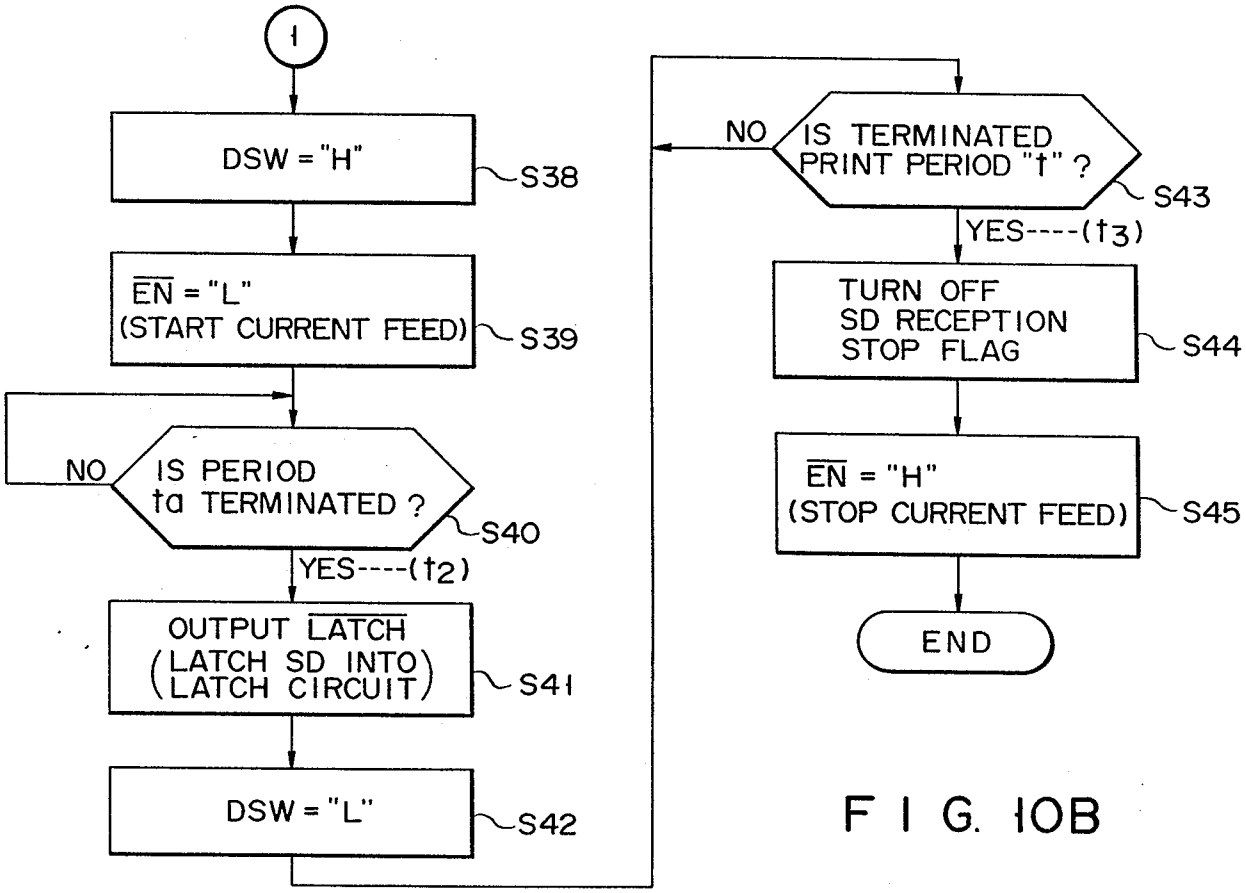

FIGS. 10A and 10B cooperate to show a flowchart showing paper feed and printing processings of one line, in accordance with the second embodiment of this invention. The operation of the second embodiment will be further described with reference to those figures of drawings. At time t0 shown in FIG. 9A, CPU 12 drives paper feed motor 15 through motor drive circuit 14, to start the paper feed of one line (step S31). When thermal head 13' was not in printing before start of the processing of step S31, viz., when the printer receives the print data of the first line from host computer 17, an initializing step is needed, that is, it is necessary to clear data registered and latched in shift register 21 and latch circuit 22 of line thermal head 13'. Conversely, when thermal head 13' was in printing, the print data SD of the previous line has been stored in shift register 21, and also in latch circuit 22.

CPU 12 checks if print data SD is receivable or not, by referring to a print data SD reception stop flag (step S32). If the answer is yes, print data SD is received (step S33). The print data SD thus received is transferred to shift register 21 of line thermal head 13' (step S34). Then, CPU 12 checks if the reception and transfer of the one-line print data SD are completed (step S35). If such jobs are completed, the print data SD reception stop flag is turned on (step S36). CPU 12 checks if the paper feed of one line is completed (step S37). When the reception and transfer of the one-line print data SD are not completed, and the paper feed of one line is not completed, the operation is returned to step S32, and repeats the above sequence of operations.

If the paper feed of one line is completed (time point t1), inverse control pulse DSW is set in a high level, and CPU 12 causes the inverter circuit 27 of line thermal head 13' to produce inverse data $\overline{SD}$ (step S38). Further, print enable pulse $\overline{EN}$ is set in low level, to set up a current feed state (step S39). In this case, inverse data $\overline{SD}$ of the previous line has been supplied to the heating resistor circuit 25 of line thermal head 13' in step S38. Therefore, the heating resistor elements of heating resistor circuit 25 are heated in accordance with inverse data $\overline{SD}$ bar of the previous line.

Succeedingly, CPU 12 judges if the period $t_a$ in print period "t" terminates or not (step S40). If it terminates (time point t2), latch pulse $\overline{LATCH}$ is output from CPU 12, the print data SD of the present line is latched in the latch circuit 22 of thermal head 13' (step S41). Further, inverse control pulse DSW is set in a high level (step S42). Then, the inverter circuit 27 of line thermal head 13' produces the print data SD of the present line latched in latch circuit 22. Subsequently, current is fed to the heating resistor elements of heating resistor circuit 25 according to the latched print data SD of the present line.

CPU 12 checks if print period "t" terminates or not (step S43). If print period "t" terminates (time point t3), CPU 12 turns off the print data SD reception stop flag (step S44), and further it sets print enable pulse $\overline{EN}$ in a high level, to set up a current-feed end status (step S45).

In this way, the paper feed and printing operations of one line are performed, and for the next line, if it must be printed, the above sequence of operations will be repeated.

As described, also in the second embodiment, the print period "t" of each line is divided into two periods, period $t_a$ and $t_b$. During the former period $t_a$, the current fed to the heating resistor elements is controlled according to the inverse data $\overline{SD}$ of the previous line, and during the latter period $t_b$, the print data SD of the present line is used for controlling the current feed to the resistors. In this way, the current feed for each line is controlled allowing for the print data SD of the previous line, so that the current feed control will be based on the print history. The resultant printed dots, therefore, is uniform in color density.

In the first and second embodiments, control is made such that the inverse data $\overline{SD}$ of the previous line and the print data SD of the present line appear during the print period "t" of each line. A current feed time is selected allowing for the print data SD of the previous line. It is understood that the present invention is not limited to such an arrangement as not to hold the print data SD of the previous line. Alternatively, it is retained, and a current feed time is controlled through a logical operation.

The above alternative may be implemented into a third embodiment as is shown in FIG. 11. This figure shows combination patterns of inverse data $\overline{SD}$ and print data SD, vs. current feed patterns. In the third embodiment, the print data SD of the previous line is stored in buffer RAM 12*a* in CPU 12 or a register additionally provided (not shown). For the inverse data $\overline{SD}$ and the present print data SD, a logical operation is applied; $\overline{SD}\cdot SD$. By the logical operation, the current feed is inhibited in the data combination pattern (0, 0). In this case, a current feed duration of time is mathematically expressed by $$\Delta t = t_a \cdot SD_{n-1} \cdot SD_n + t_b SD_n$$

In the third embodiment, the inverse data $\overline{SD}$ of the previous line must be retained, but the current feed may be inhibited for the combination pattern (0, 0). Therefore, the third embodiment has an advantage that time period $t_a$ may be selected appropriately.

It is evident that this invention is applicable not only for the thermal printer for printing line by line, but also for the thermal dot printer for printing dot by dot.

What is claimed is:

1. A thermal printer for printing previous and present print data during previous and present print periods, respectively, comprising:

buffer means for storing print data;

heating resistor means for generating heat to color a thermosensitive paper when current is fed to said heating resistor means during the present period;

data output means for outputting, during the previous period, the inverse of the print data from the previous print period, and for outputting the present print data stored in said buffer means, after the previous print period and before the present print period;

data storing means for storing first the inverse data and then the present print data output from said data output means;

latch means for latching data stored in said data storing means;

latch control means for latching in said latch means the inverse data stored in said data storing means after the previous print period and before the present print period, and for latching the present print data stored in said data storing means in the middle of the present print period; and current feed means for feeding current to said heating resistor means during the present print period, first in accordance with the inverse data and then in accordance with the print data latched in said latch means.

2. The thermal printer according to claim 1, wherein said latch control means latches in said latch means, before said data output means outputs said print data, during said period between the present print period and the present print period.

3. The thermal printer according to claim 2, wherein said latch control means latches the print data stored in said storing means into said latch means in the middle of the present print period after the latching of the inverse data, and at the timing before, as the result of the current feed to said heating resistor means in accordance with the latched inverse data by said current feed means, said heating resistor means is heated and its temperature reaches a temperature at which coloring of the thermosensible paper starts.

4. The thermal printer according to claim 1, wherein said latch control means includes latch pulse output means for outputting a first latch pulse to latch the inverse data stored in said data storing means into said latch means at a timing before the outputting of the print data by said data output means during said period between the previous print period and the present print period, and a second latch pulse to latch the print data stored in said data storing means into said latch means in the middle of the present print period after the latching of the inverse data, and at the timing before, as the result of the current feed to said heating resistor means in accordance with the latched inverse data by said current feed means, said heating resistor means is heated and its temperature reaches a temperature at which coloring of the thermosensible paper starts.

5. The thermal printer according to claim 4, wherein said latch pulse output means outputs the second latch pulse at the termination of the present print period of 20%.

6. The thermal printer according to claim 4, wherein said heating resistor means includes a plurality of heating resistor elements, said data storing means includes a shift register of the same number of bits as that of said heating resistor elements, and said latch means includes a latch circuit of the same number of bits as that of said heating resistor elements.

7. A thermal printer for printing previous and present print data during previous and present print periods, respectively, comprising:

buffer means for storing print data;

heating resistor means for generating heat to color a thermosensitive paper when current is fed to said heating resistor means during the present period;

print data output means for outputting the print data stored in said buffer means;

data storing means for storing the print data output from said data output means after the middle of the previous print period and before the middle of the present print period;

data inverting means for inverting the previous print data stored in said data storing means to form inverse data; and current feed control means for feeding current to said heating resistor means in accordance with the inverse data at the start of said present print period, and for feeding current to said heating resistor means in accordance with the print data stored in said data storing means in accordance with the print data stored in said data storing means in place of said inverse data during the present print period.

8. The thermal printer according to claim 7, wherein said data storing means includes register means for storing the print data output from said print data output means, and latch means for latching the print data stored in said register means in the middle of the present print period, and said data inverting means inverts the print data latched in said latch means.

9. The thermal printer according to claim 8, further comprising latch control means for latching the print data stored in said register means into said latch means in the middle of said present print period.

10. The thermal printer according to claim 9, wherein said latch control means latches the print data stored in said register means into said latch means at the timing before, as the result of the current feed to said heating resistor means in accordance with the latched inverse data by said current feed means, said heating resistor means is heated and its temperature reaches a temperature at which coloring of the thermosensible paper starts.

11. The thermal printer according to claim 10, wherein said latch control means includes latch pulse output means for outputting a latch pulse to latch the print data stored in said register means into said latch means at the timing before, as the result of the current feed to said heating resistor means in accordance with the latched inverse data by said current feed means, said heating resistor means is heated and its temperature reaches a temperature at which coloring of the thermosensible paper starts.

12. The thermal printer according to claim 11, wherein said latch pulse output means outputs the latch pulse to latch the print data stored in said register means into said latch means at the termination of the present print period of 20%.

13. The thermal printer according to claim 11, wherein said heating resistor means includes a plurality of heating resistor elements, said register means includes a shift register of the same number of bits as that of said heating resistor elements, and said latch means includes a latch circuit of the same number of bits as that of said heating resistor elements.

14. A method for controlling the feed of current to heating resistor means in use with a thermal printer comprising the steps of:

outputting the inverse data of print data of a previous print period preceding to a present print period during the previous print period;

storing the output inverse data into data storing means in accordance with the data output;

latching the inverse data stored in said storing means into latch means during a period between the previous print period and the present print period;

outputting present print data after the inverse data is latched and during a period between the previous print period and the present print period;

storing the output present print data into said data storing means in accordance with the data output;

feeding current to said heating resistor means at the start of the present print time according to the inverse data latched in said latch means:

latching the present print data stored in said storing means into said latch means in the middle of the present print period; and feeding current to said heating resistor means in accordance with the present print data latched in said latch means in the middle of the present print period.

15. A method for controlling the feed of current to heating resistor means in use with a thermal printer comprising the steps of:

storing print data to be printed during the present print period, into data storing means during a period between a previous print period and a present print period;

forming inverse data by inverting at the start of the present print period the print data in the previous print period preceding to the present print period, which is latched in latch means during the previous print period;

feeding current to said heating resistor means in accordance with the inverse data;

latching the print data stored in said storing means into said latch means in the middle of the present print period; and feeding current to said heating resistor means in accordance with the print data latched in said latch means till the present print period terminates.

16. A thermal head for driving a plurality of heating resistor elements, comprising:

a data input terminal for receiving data;

a latch input terminal for receiving a latch signal;

an inversion control input terminal for receiving an inversion control pulse;

a print allowance print terminal for receiving a print allowance pulse;

output terminals of the same number as that of the heating resistor elements for supplying drive signals to the heating resistor elements;

a shift register connected to said data input terminal, for storing data input through said data input terminal, said shift register including the same number of bits as said heating resistor elements, and having output terminals of the same number as that of the heating resistor elements, for outputting data of each bit;

a latch circuit connected to said latch input terminal and to the output terminals of said shift register, for latching data stored in said shift register in response to a latch signal input through said latch input terminal, said latch circuit including the same number of bits as said heating resistor elements, and having output terminals of the same numbers as that of the heating resistor elements for outputting data of each bit;

a plurality of inversion circuits, each connected to said inversion control input terminal and to one of the output terminals of said latch circuit, for inverting and outputting data from the output terminals of said latch circuit in response to the inversion control pulse received through said inversion control input terminal, the number of said inversion circuits being the same as that of said heating resistor elements;

a plurality of gate circuits, each connected to said print allowance input terminal and to one of said inversion circuits, for selectively outputting data from said inversion circuits in response to the print allowance pulse received through said print allowance input terminal, the number of said gate circuits being the same as that of said heating resistor elements; and a plurality of inversion elements, each connected between one of said gate circuits and one of said output terminals, for inverting data output from a gate circuit and supplying inverse data to an output terminal, the number of said inversion elements being the same as that of said heating resistor elements.

* * * * *